United States Patent [19]

Ryan

[11] 4,157,141

[45] Jun. 5, 1979

[54] GOLF BALL PICK-UP APPARATUS

[76] Inventor: Timothy A. Ryan, 1607 Pine St., Harlan, Iowa 51537

[21] Appl. No.: 836,769

[22] Filed: Sep. 26, 1977

[51] Int. Cl.[2] ..... B60P 1/00

[52] U.S. Cl. ..... 414/440; 56/328 R; 171/66

[58] Field of Search ..... 214/350, 351, 352, 353, 214/355, 354, 356; 171/66, 78; 56/328 R

[56] References Cited

U.S. PATENT DOCUMENTS

| | | | |
|---|---|---|---|
| 3,362,551 | 1/1968 | Shoemaker | 214/356 |
| 3,595,000 | 7/1971 | Recker | 56/328 R |
| 3,669,289 | 6/1972 | Mattison | 214/353 |
| 3,795,335 | 3/1974 | Hansen, Jr. | 214/302 |

*Primary Examiner*—Lawrence J. Oresky
*Attorney, Agent, or Firm*—Bacon & Thomas

[57] ABSTRACT

An open bottomed wheeled carriage has upstanding side plates between which a flexible mat is dragged over the ground. The front end only of the mat is secured to a cross bar on the carriage at a height greater than that of a golf ball on the ground. The mat is made up of pivotally joined rings or rings and links or parallel chains so that balls on the ground over which the mat is pulled will pass upwardly through the rings or between links or chains to the upper surface of the mat. A cleated endless belt, driven by the carriage supporting ground wheels, sweeps the balls rearwardly over the mat into a container on the rear of the carriage.

6 Claims, 4 Drawing Figures

GOLF BALL PICK-UP APPARATUS

BACKGROUND OF THE INVENTION

This invention is in the field of devices for picking up loose articles lying on the ground.

Golf practice ranges are in wide use and one of the problems in their operation is the retrieving or gathering of used balls for reuse, which balls are scattered over a wide area. Devices have been used for gathering such balls by merely dragging the apparatus over the range area. Some such devices comprise a multiplicity of rotatable discs which pinch the golf balls between them and lift them from the ground into a receiver. Such devices are complicated and expensive to construct and not entirely dependable in operation. Other proposals suggested the use of strips of material arranged in parallel spaced relation adapted to be dragged over the ground. The leading ends of the strips are held above the tops of golf balls on the ground and are narrow at their forward ends to permit golf balls to pass therebetween onto the upper surfaces of the strips whose more rearward portions are sufficiently wide to inhibit passage of the balls downwardly between adjacent edges. A rotary brush is proposed for sweeping balls off the strips into a container. The strips are either flexible straps or structures formed of relatively stiff wire. Examples of such devices are shown in the U.S. Pat. Nos. to Shoemaker 3,362,551 and Recker 3,595,000.

SUMMARY OF THE INVENTION

The present invention employs a flexible perforated mat to be dragged over balls on the ground so that the balls pass upwardly through the perforations and are swept into a receiver by a cleated endless belt.

It is, therefore, a principal object of this invention to provide a ball pick-up apparatus that is simple and inexpensive to construct and yet efficient and reliable in operation.

DESCRIPTION OF A PREFERRED EMBODIMENT

Figure 1:
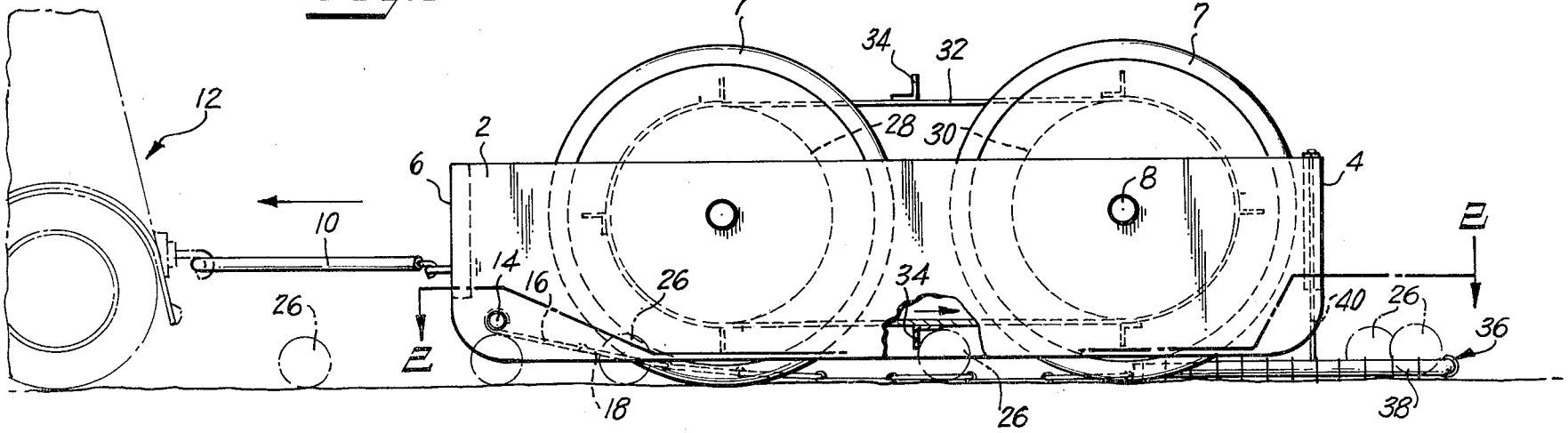
FIG. 1 is a side elevational view of a device embodying the present invention.

As shown in the drawings, a carriage comprises upstanding side walls or panels 2 held spaced apart at their end by upright panels or walls 4 and 6. As best shown in FIG. 1, the panels 4 and 6 extend only part way downwardly from the upper edge of the side panels 2 to leave considerable space therebelow. The carriage is supported for movement over the ground by ground engaging wheels 7 arranged in pairs on the axles 8. A suitable towing member or the like 10 is provided and pivotally secured to the front wall 6 for towing the carriage behind any suitable towing vehicle such as the cart suggested at 12 in FIG. 1. Extending between the side panels 2 a short distance rearwardly of the front panel 6 is a tow bar 14 positioned at an elevation above the ground greater than the height of a golf ball lying on the ground.

Figure 2:
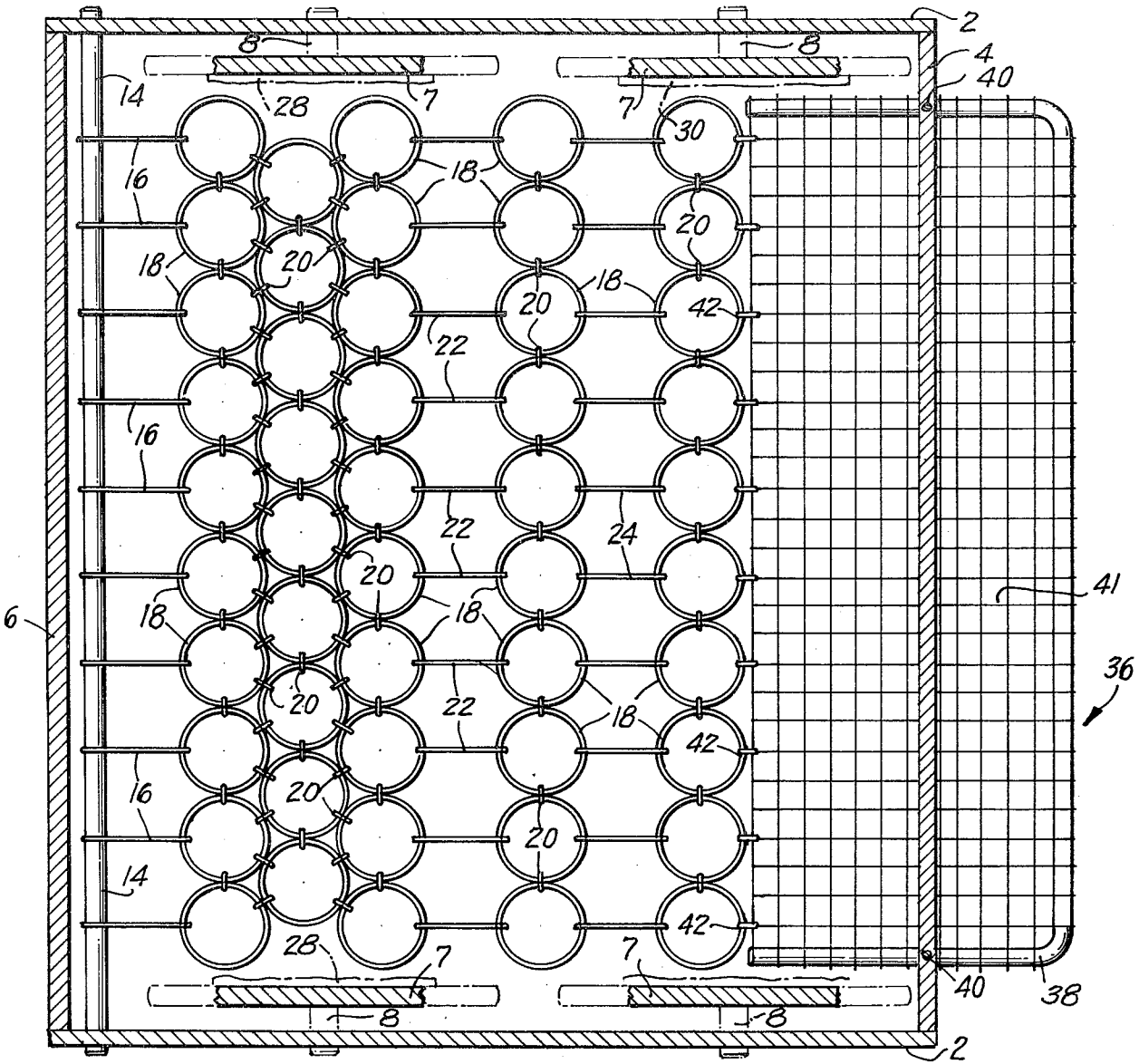
FIG. 2 is a horizontal sectional view taken on the line 2—2 of FIG. 1.

As best shown in FIG. 2, a plurality of links 16 engage the tow bar 14 by being looped therearound and extend somewhat pendulously downwardly and rearwardly therefrom. A first transverse row of rings 18 comprising wire or the like rings held together at their points of contact by pivot loops 20 is attached to the links 16 to be pivoted thereon. As shown, each ring of the first row is pivotally attached to a corresponding link 16. The distance between links 16 and the inner diameters of the rings 18 are each slightly greater than the diameter of a golf ball. Second and third transverse rows of rings 18 are also pivotally interconnected with each other and to the rings of adjacent rows by pivot loops 20 as previously described. As shown, links 22 extend rearwardly from each of the rings of the third row and are in turn connected to corresponding rings of a fourth row of rings 18 and further links 24 connect that fourth row of rings to the fifth row of rings, all as shown. In all cases the space between links 16, 22 and 24 and the inner diameters of the rings are slightly greater than the diameter of a golf ball and the structure thus described comprises a flexible mat having a multiplicity of openings therethrough, through which golf balls may pass. It is obvious that the second and third sets of links may be omitted and replaced by intermediate rows of rings staggered with relation to the fourth and fifth rows in the same manner as is the second row of rings staggered with relation to the first and third row.

When the carriage is drawn over the ground on which are located randomly placed golf balls to be picked up, the tow member 14 will pass over those balls and since the flexible mat previously described drags along the ground, those golf balls will enter and pass upwardly through spaces between the links 16 and/or through the rings 18 to the upper surface of the flexible mat, as shown at 26 in FIG. 1. Even if one of the links 16 were to engage a golf ball directly over the center thereof that ball would then pass through the ring connected to that particular link. In the event a golf ball was in a position to enter between links 16, it could either pass over the next two adjacent rings or the mat could ride over that particular ball which would then pass through the mat through the staggered ring in the second row. Thus, the mat will be effective to pass all golf balls over which it is dragged and to cause the same to move upwardly through the mat to the upper surface thereof.

Obviously, a suitable flexible mat structure could be of any desired material or configuration, either all rings or all links, such as an articulated mesh of short links, or even a continuous web of material having staggered openings therethrough for passage of the golf balls.

Figure 3:
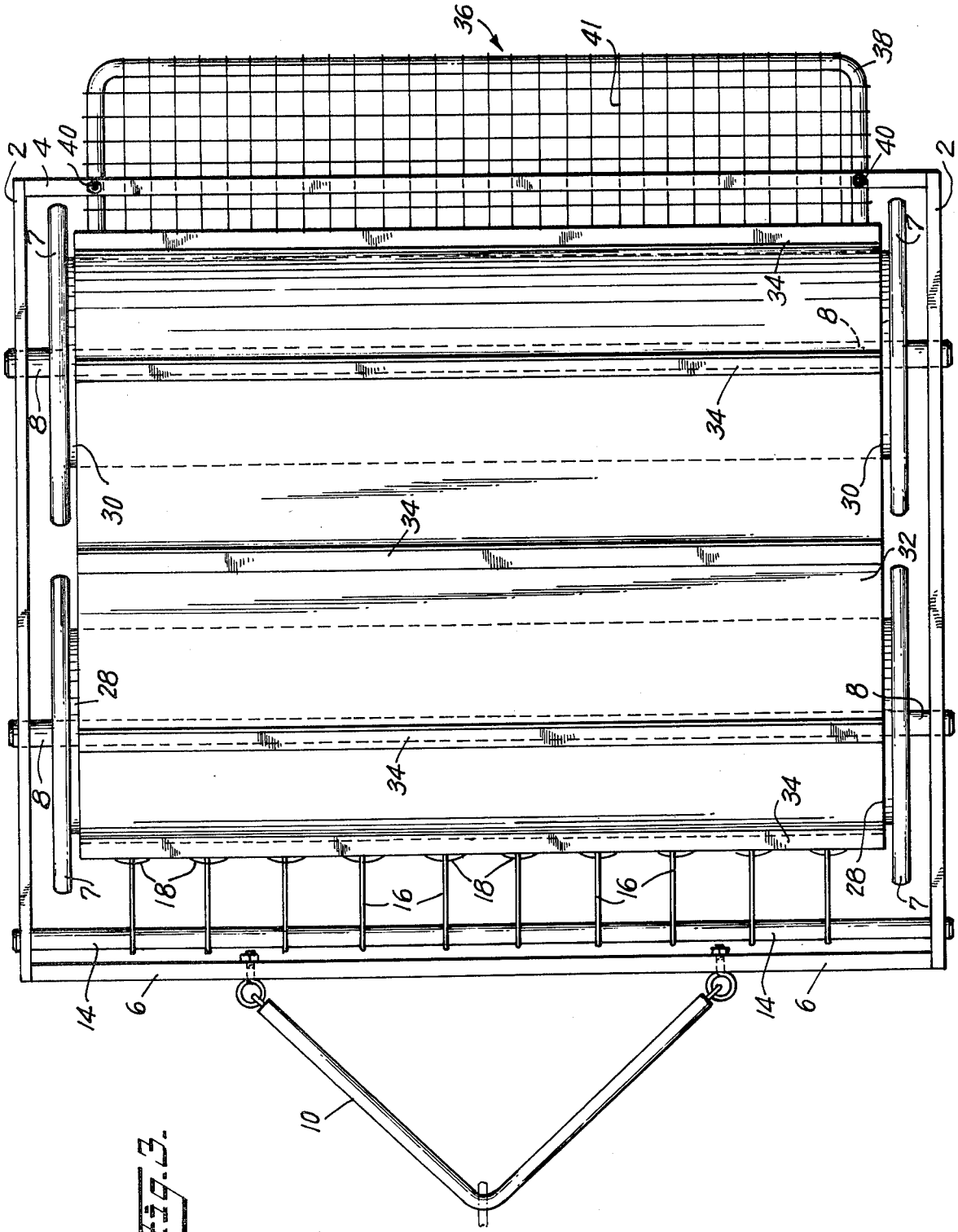
FIG. 3 is a top plan view.

Referring now to FIG. 3, it will be seen that drums 28 and 30 extend between the respective front and rear pair of ground wheels. Those drums are fixed to the wheels to rotate therewith. An endless belt 32 is trained over both drums 28 and 30 and extends laterally across the carriage the full width of the flexible mat described. It is to be noted that the diameters of the drums 28 and 30 are such that their lower surfaces are spaced above the ground a distance at least equal to or slightly greater than the diameter of a golf ball. The outer surface of the endless belt 32 is provided with transverse cleats or pusher bars 34 extending across the width of the belt and secured thereto in any suitable manner. It will be obvious that as the carriage is drawn forwardly over the ground and golf balls sequentially pass upwardly through the flexible mat, they will be located beneath the lower run of endless belt 32. As the wheels 6 rotate in a forward direction, the cleats 34 on the belt 32 are caused to move rearwardly relative to the carriage and flexible mat and thus will sweep the golf balls rearwardly over the top of the flexible mat toward the rear of the carriage.

At the rear of the carriage a wire mesh receiver 36 is provided. The receiver comprises a heavy wire frame 38 secured to the rear panel member 4 by bolts 40 or the like and the receiver is so positioned that the bottom defined by a wire mesh 41 is substantially at a ground level and coplanar with the rear portion of the flexible mat. As shown in FIG. 2, the rings 18 of the rearmost row of rings are adjacent to the front edge of the wire mesh of the receiver and are preferably secured to that forward edge by suitable rings 42 or the like. As will be obvious, the golf balls swept rearwardly by the cleats 34 are caused to accumulate on the receiver 36 where they may be readily removed for further use.

By attaching the rear row of rings to the wire mesh 41 it is practically impossible for the device to pass completely over a golf ball on the ground without that ball passing upwardly through the flexible mat.

Figure 4:
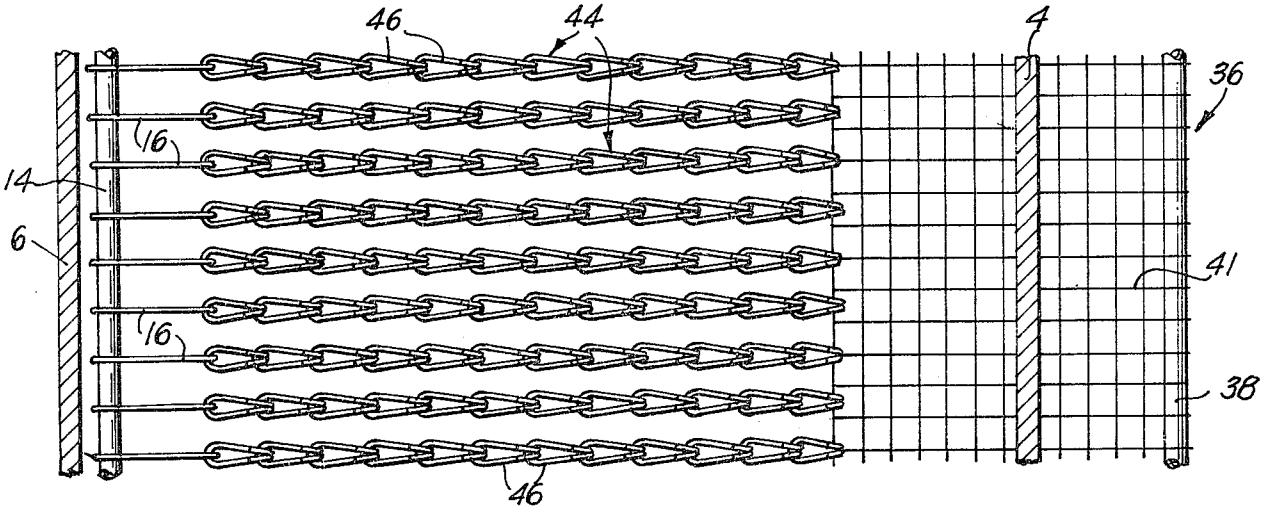
FIG. 4 is a fragmentary view of an alternative embodiment of flexible mat.

Referring now to FIG. 4, the embodiment shown therein employs a different form of flexible mat. In this form, the mat comprises an articulated link chain comprising lengths 44 of chain attached to the ends of the members 16 to trail therebehind. Each chain section 44 comprises a plurality of individual links 46 pivotally joined together whereby the chain is articulated and it is intended that the chains be fairly heavy. The space between adjacent parallel chain lengths is less than the diameter of a golf ball. It is contemplated also that the rear ends of each chain length be pivotally secured to the forward edge of teh wire mesh 41.

It will be obvious that the leading ends of the chain lengths 44 will engage the upper portions of any golf balls lying on the ground and the weight of the chains coupled with their flexible material will permit two adjacent chains to separate slightly and drop downwardly around the ball and then tension in the chains as they are dragged along causes the ball to rise to ride on the upper surface of the mat and to be swept into the receiver, all as previously described. By employing separate chain lengths, the mat can work its way down and around the golf balls even though the latter may be buried in deep grass or lie in shallow traps in the ground. Such a mat as shown in FIG. 4 may be provided for replacing or interchanging with the mat shown in FIGS. 1–3, depending upon the nature and smoothness of the ground on a particular driving range.

While a single specific embodiment of the invention has been shown and described, the same is merely illustrative of the principles of the invention and other forms may be resorted to within the scope of the appended claims.

I claim:

1. A golf ball pick-up apparatus comprising:

a carriage adapted to be moved over the ground;

a flexible mat having its forward edge secured to a front portion of said carriage and at an elevation thereon greater than the height of a golf ball, said mat having a multiplicity of openings therethrough whereby golf balls on the ground will pass upwardly through said openings to the upper surface of said mat as said carriage and mat are moved forwardly over the ground;

a container on the rear portion of said carriage and adjacent the rear edge of said mat;

sweep means on said carriage for sweeping golf balls rearwardly over said mat to said container;

said mat comprising a group of abutting rings, each having an inner diameter slightly greater than a golf ball, with each ring pivotally linked to adjacent rings at their points of tangency.

2. Apparatus as defined in claim 1 wherein said group of rings is a plurality of transverse rows of said rings and links pivotally connecting the rings of said rows, the spaces between said links and between said rows defining certain of said openings.

3. A golf ball pick-up apparatus comprising:

a carriage adapted to be moved over the ground;

a flexible mat having its forward edge secured to a front portion of said carriage and at an elevation thereon greater than the height of a golf ball, said mat having a multiplicity of openings therethrough whereby golf balls on the ground will pass upwardly through said openings to the upper surface of said mat as said carriage and mat are moved forwardly over the ground;

a container on the rear portion of said carriage and adjacent the rear edge of said mat;

said carriage having ground engaging wheels;

sweep means comprising an endless belt having a lower run extending horizontally from about the front of said mat to said container and having laterally extending cleats extending downwardly toward said mat sufficiently to engage and sweep golf balls therealong to said container, and means for driving said belt from said ground engaging wheels in a direction to move said lower run rearwardly relative to said carriage.

4. Apparatus as defined in claim 3 wherein said flexible mat comprises a multiplicity of parallel articulated chains secured to said front portion of said carriage and trailing rearwardly therefrom, the space between adjacent chains being less than the diameter of a golf ball.

5. Apparatus as defined in claim 3 wherein the rear ends of said chains are secured to said container.

6. Apparatus as defined in claim 3 wherein said ground engaging wheels comprise front and rear wheels each having a cylindrical drum coaxially secured thereto, said endless belt being trained over said drums.

* * * * *